US007770309B2

(12) United States Patent
Scofield

(10) Patent No.: US 7,770,309 B2
(45) Date of Patent: Aug. 10, 2010

(54) ADJUSTABLE ARCH INSOLE

(75) Inventor: Robert K. Scofield, Lake Oswego, OR (US)

(73) Assignee: DashAmerica, Inc., Louisville, CO (US)

( * ) Notice: Subject to any disclaimer, the term of this patent is extended or adjusted under 35 U.S.C. 154(b) by 606 days.

(21) Appl. No.: 11/701,090

(22) Filed: Jan. 31, 2007

(65) Prior Publication Data

US 2008/0178493 A1 Jul. 31, 2008

(51) Int. Cl.
*A43B 7/14* (2006.01)
*A43B 7/22* (2006.01)
*A43B 13/38* (2006.01)

(52) U.S. Cl. ..... 36/165; 36/159; 36/91; 36/44

(58) Field of Classification Search ..... 36/159–165, 36/43, 91, 44
See application file for complete search history.

(56) References Cited

U.S. PATENT DOCUMENTS

| | | | | | |
|---|---|---|---|---|---|
| 1,469,607 | A | * | 10/1923 | Scholl | 36/159 |
| 1,797,143 | A | * | 3/1931 | Havey | 36/164 |
| 1,852,660 | A | * | 4/1932 | Laisure | 36/165 |
| 2,732,636 | A | * | 1/1956 | Amico | 36/160 |
| 2,965,984 | A | * | 12/1960 | Scholl | 36/164 |
| 3,339,555 | A | * | 9/1967 | Rotko | 36/165 |
| 4,336,661 | A | | 6/1982 | Medrano | |
| 4,571,853 | A | | 2/1986 | Medrano | |
| 4,578,882 | A | | 4/1986 | Talarico | |
| 4,590,689 | A | | 5/1986 | Rosenberg | |
| 4,638,577 | A | | 1/1987 | Riggs | |
| 5,138,774 | A | * | 8/1992 | Sarkozi | 36/164 |
| 5,224,277 | A | | 7/1993 | Sang Do | |
| D460,854 | S | | 7/2002 | Hung | |
| 6,562,427 | B2 | | 5/2003 | Hung | |
| 7,241,789 | B2 | | 7/2007 | Lu et al. | |
| 2007/0017123 | A1 | | 1/2007 | Scofield et al. | |
| 2007/0033837 | A1 | | 2/2007 | Fulton | |

* cited by examiner

*Primary Examiner*—Ted Kavanaugh
(74) *Attorney, Agent, or Firm*—Sheridan Ross, P.C.

(57) ABSTRACT

A removable insert for footwear has a slot placed in its medial edge which extends below the arch. An insert placed into the slot has a height which establishes how much the arch protrudes above the remainder of the top surface of the insole. Multiple inserts are provided having different thicknesses so that the height of the arch can be varied.

1 Claim, 2 Drawing Sheets

ADJUSTABLE ARCH INSOLE

BACKGROUND OF THE INVENTION

Different people need different amounts of arch support in the footwear they wear. In addition, the wearer's need for arch support can vary and occasionally more arch support may be desirable. Heretofore if greater than normal arch support is required it is necessary to purchase footwear already having a larger arch or to install an orthotic insole. The former requires the seller of the footwear to carry an inventory of footwear having multiple size arches and the latter is expensive.

BRIEF SUMMARY OF THE INVENTION

The subject invention overcomes this problem with prior art footwear by placing a slot in the medial edge of a removable insole below the arch and placing a removable insert into the slot. A plurality of inserts are provided allowing the user to use an insert having varying thicknesses thereby varying the height of the arch.

The foregoing and other objectives, features, and advantages of the invention will be more readily understood upon consideration of the following detailed description of the invention, taken in conjunction with the accompanying drawings.

DETAILED DESCRIPTION OF PREFERRED EMBODIMENT

Figure 1:
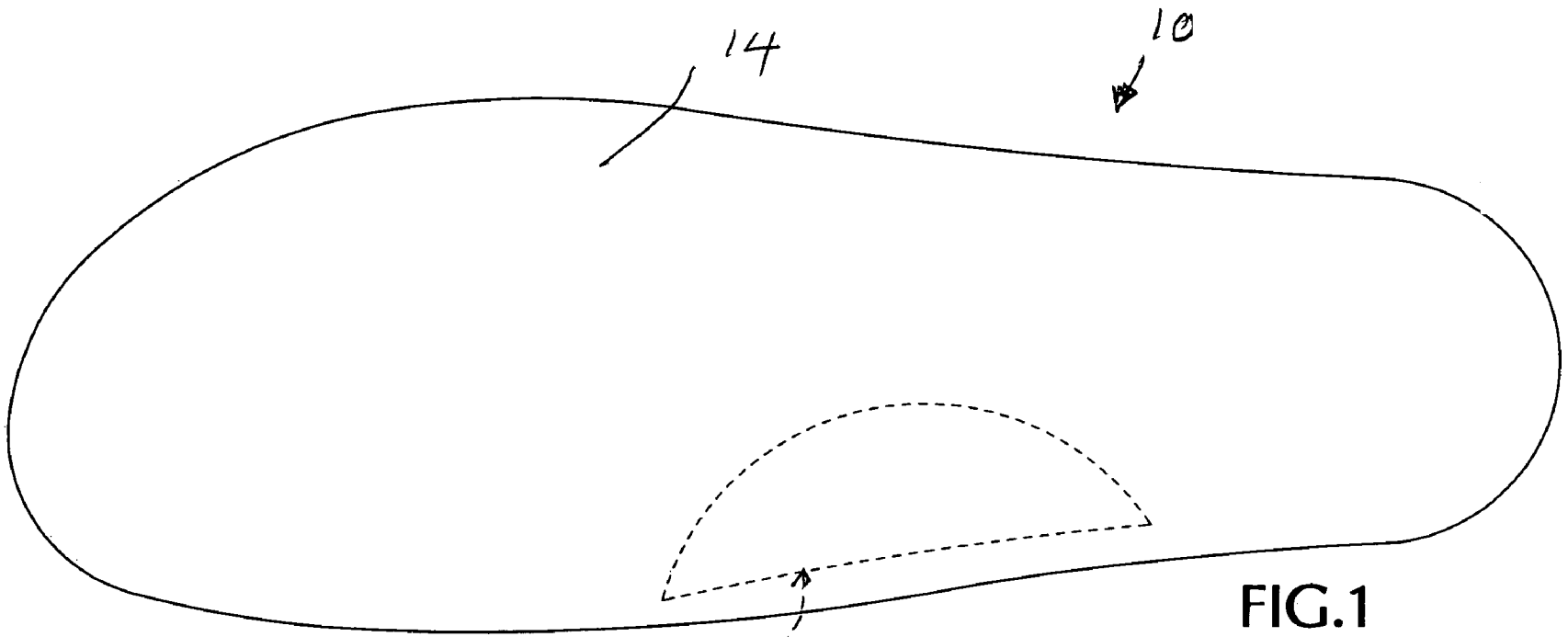
FIG. 1 is a plan view of an insole embodying the subject invention.
Figure 2:
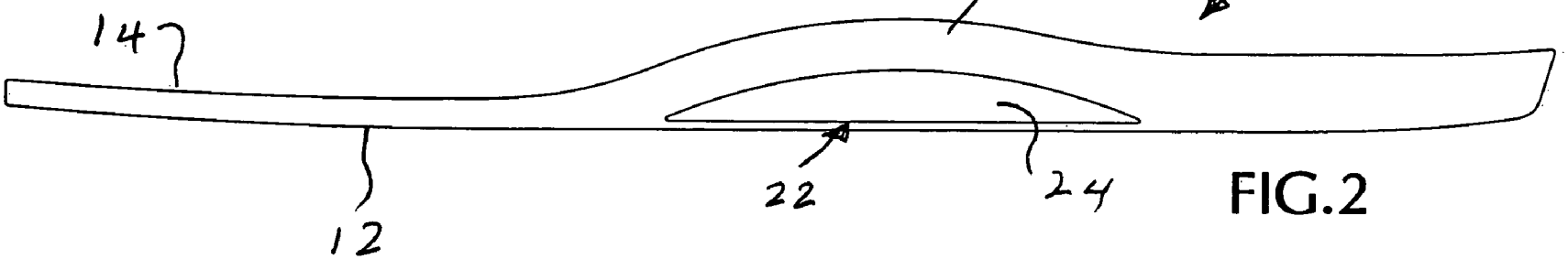
FIG. 2 is a side elevation view of the insole.
Figure 3:
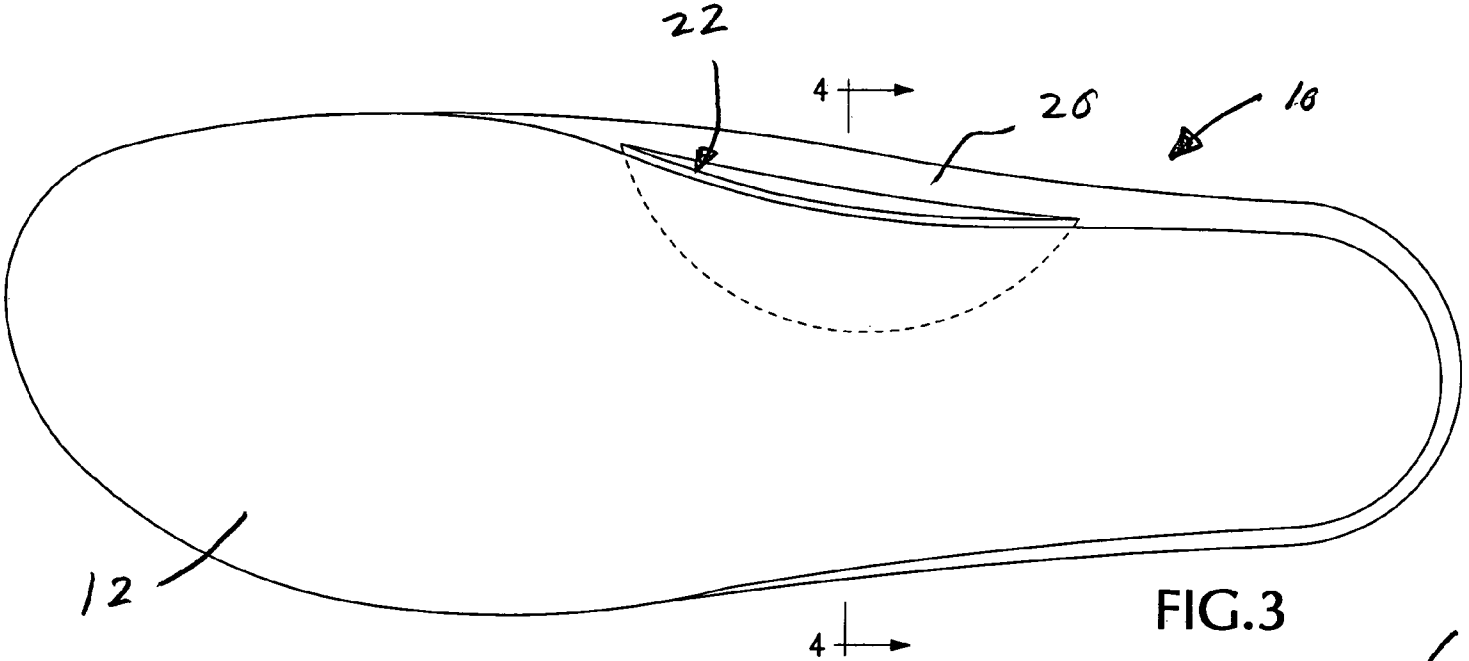
FIG. 3 is a bottom view of the insole.
Figure 5:
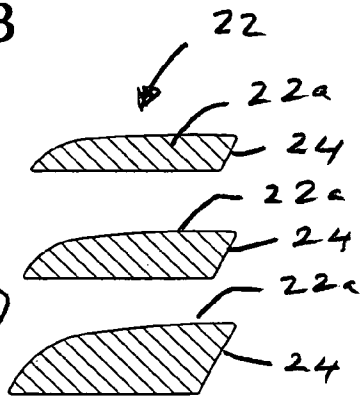
FIG. 5 is a cross-sectional view taken on the line 4-4 of FIG. 3 without an insert installed.
Figure 4:
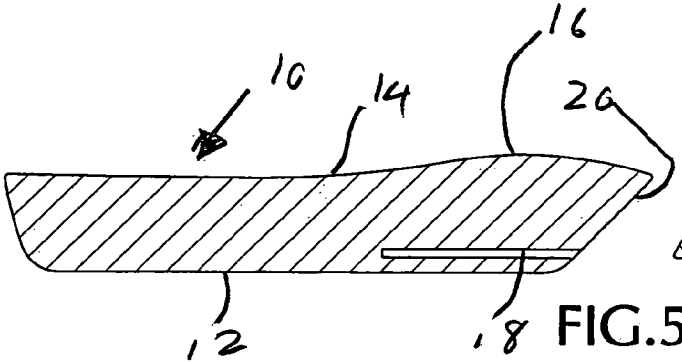
FIG. 4 is a cross-sectional view taken on the line 4-4 of FIG. 3 with an insert installed in the insole.
Figure 4:
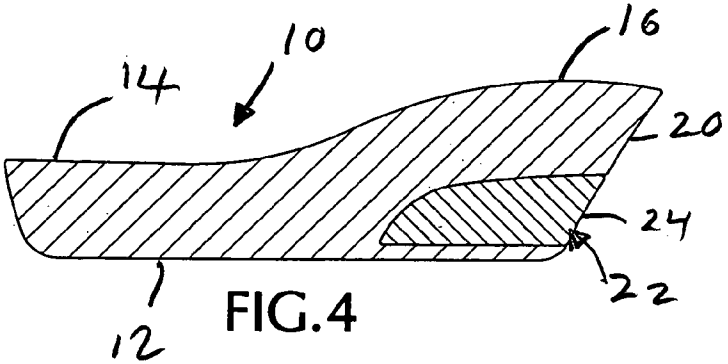

Referring to the drawings, an arch support system includes an insole 10 which is configured to fit removably within a shoe, boot or other type of footwear. The insole 10 has a bottom surface 12 which is generally planar and rests on the stroble fabric that forms the bottom of the footwear upper (not shown) when the insole is inserted into the footwear. The insole 10 has a top surface 14 which is planar and is parallel with the bottom surface 12 over most of its extent except that it has a protruding semi-circular arch 16 along its central medial edge. As will be more fully explained later, the arch 16 in the subject insole is less than the arch normally provided in footwear. The foot of a user rests on top of the top surface 14 with the arch extending upwardly against the user's foot. The insole 10 preferably is molded from a polyurethane foam or similar material to provide an appropriate combination of support and comfort. Located in the insert between the top surface 14 and bottom surface 12 under the arch 16 is a thin slot 18. The slot 18 preferably is semi-circular and underlies the entire arch 16. The slot opens out of medial side 20 of the insole 10. In the embodiment illustrated the slot is near the bottom of the medial side of the insole 10 but it could be higher if desired.

The arch support system also includes a plurality of inserts 22 which have generally the same semi-circular shape as the slot 18 so that they can be inserted into the slot and substantially fill it. The insert 22 is the thickest at its center and the thinnest at its periphery. In the embodiment illustrated it has a semi-circular center portion where the thickness varies gradually and a semi-annular outer section where the thickness varies rapidly. For purposes of this application when an insert is said to have a specific thickness it refers to its maximum thickness. Preferably when an insert is in the slot its outer edge 24 is flush with the medial side 20 of the insole. In the embodiment illustrated there are three inserts 22. The thinnest insert 22*a* has a thickness of slightly less than $3/16^{ths}$ inch. The insole is sized such that when the insert 22*a* is in place the arch is about normal for the particular type of footwear the insole is used with. The other two inserts increase the size of the arch above its normal size. The thickest insert 22*c* has a thickness of around $3/8^{ths}$ inch. Thus, with this insert placed in the slot 18 the height of the arch is about $3/16^{ths}$ inch above its height when the thinnest insert is in place. Obviously thicker and thinner inserts can be used, but generally the thickness would vary between 0.10 inch and 0.50 inch. The insert preferably is made from ethylene vinyl acetate foam but it could be made from other open cell foams or other materials, such as cork.

The adjustable arch system allows a shoe to have an arch that is sized to work for the particular user without having to carry multiple arch sizes in inventory. In addition, the arch size can be changed to address problems that might occur or the need for more arch support in the footwear.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. An adjustable arch support system for footwear comprising:

(a) a polyurethane foam insole having a generally planar lower surface;

(b) the insole having a semicircular arch which protrudes from a top surface of the insole along a central, medial edge of the insole;

(c) the insole having a semicircular slot between the top surface and the bottom surface of the insole along the central, medial edge of the insole, whereby the semicircular slot underlies the semicircular arch;

(d) a plurality of removable semicircular ethylene vinyl acetate foam inserts having a thickness, whereby the inserts fits into and substantially fills the slot and is flush with the central, medial edge of the insole; and (e) whereby the thickness of the inserts varies gradually such that the thickness is the greatest at a center of the insert and thinnest at a periphery of the insert.

* * * * *